US006495965B1

(12) United States Patent
Yamaura et al.

(10) Patent No.: US 6,495,965 B1
(45) Date of Patent: Dec. 17, 2002

(54) COLD CATHODE ELECTRONIC DEVICE

(75) Inventors: Tatsuo Yamaura, Mobara (JP); Shigeo Itoh, Mobara (JP); Gentaro Tanaka, Mobara (JP); Yuji Uchida, Mobara (JP); Yuuich Kogure, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/357,651

(22) Filed: Jul. 20, 1999

(30) Foreign Application Priority Data

Jul. 21, 1998 (JP) ..... 10-205247
Jul. 21, 1998 (JP) ..... 10-205248

(51) Int. Cl.[7] ..... H05B 37/00
(52) U.S. Cl. ..... 315/167; 315/169.1; 313/552
(58) Field of Search ..... 315/167, 169.1, 315/169.4; 345/211; 313/484, 485, 486, 309, 302, 310, 311, 312, 336, 351, 352, 552, 551

(56) References Cited

U.S. PATENT DOCUMENTS 5,686,791 A * 11/1997 Kumar et al. ..... 315/169.4
5,688,438 A * 11/1997 Chadha ..... 345/76
5,772,485 A * 6/1998 Jeng et al. ..... 445/24
5,786,659 A * 7/1998 Takagi et al. ..... 313/309
6,040,973 A * 3/2000 Okamoto et al. ..... 315/169.1
6,281,626 B1 * 8/2001 Nakamura et al. ..... 313/311

* cited by examiner

*Primary Examiner*—Don Wong
*Assistant Examiner*—Thuy Vinh Tran
(74) *Attorney, Agent, or Firm*—Oblon, Spivak, McClelland, Maier & Neustadt, P.C.

(57) ABSTRACT

A cold cathode electronic device capable of removing pollution of emitter electrodes occurring during manufacturing of the device, to thereby enhance emission characteristics of the emitter electrodes and luminous efficiency of a phosphor layer. The cold cathode electronic device includes hydrogen occlusion metal incorporated in a gate electrode and/or an anode electrode. A field emission luminous device and a cold cathode luminous device each including such a cold cathode electronic device are disclosed.

15 Claims, 11 Drawing Sheets

ANODE 22

GATE 15

CATHODE 13

COLD CATHODE ELECTRONIC DEVICE

BACKGROUND OF THE INVENTION

This invention relates to a cold cathode electronic device, and a field emission luminous device and a cold cathode luminous device each including such a cold cathode electronic device. More particularly, the present invention relates to a cold cathode electronic device which includes a cathode electrode, a gate electrode and an anode electrode and is constructed so as to permit electrons field-emitted from the cathode electrode to reach to at least one of the gate electrode and anode electrode, and a field-emission luminous device and a cold cathode luminous device each including such a cold cathode electronic device, wherein cold cathode is improved in emission characteristics and a phosphor is stabilized in luminous efficiency.

When an electric field set to be about $10^9$ (V/m) is applied to a surface of a metal material or that of a semiconductor material, a tunnel effect occurs to permit electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode (FEC)".

Recently, development of semiconductor fine-processing techniques permits a field emission cathode of the surface emission type to be constructed of field emission cathode elements having a size as small as microns. Various electronic units wherein a number of field-emission cathodes are arranged in a matrix-like manner on a substrate each function to impinge electrons selectively emitted from emitters on a phosphor, to thereby permit the phosphor to selectively emit light, resulting in being used as an electron feed means for a flat-type display device.

Now, such a conventional field emission display (FED) will be described with reference to FIG. 12. The field emission display is called a Spindt-type display device.

An FEC of the Spindt type includes a first substrate or cathode substrate 100, which is then formed thereon with a cathode electrode 101. The cathode electrode 101 is then formed thereon with a resistive layer 102, an insulating layer 103 and a gate electrode 104 in order in an upward direction. The gate electrode 104 and insulating layer 103 are formed with holes in common to each other in a manner to extend therethrough, in each of which an emitter electrode 115 of a conical shape in vertical section is provided while being placed on the resistive layer 102. The emitter electrodes 115 each are arranged in the hole while being exposed at an acute distal thereof through the hole.

Use of fine processing techniques for manufacturing of such an FEC permits a distance between the conical emitters 115 and the gate electrode 104 to be reduced to a level lower than a micron, so that mere application of a voltage as low as about tens of volts permits the emitter electrodes 115 to emit electrodes as desired.

Above the first substrate 100 on which a number of such FECs are arranged in an array is provided a second substrate or an anode substrate 116 constituting an anode electrode in a manner to be opposite thereto. The first substrate 100 and second substrate 116 cooperate with each other, as well as a side plate to form an airtight envelope, which is evacuated to form a vacuum or reduced pressure therein, resulting in the FED being provided.

In the FED thus constructed, a gate voltage Vg is applied between the gate electrode and the cathode electrode and an anode voltage VA is applied between the cathode electrode and the anode electrode, so that electrons emitted from the emitter electrodes 115 may be impinged on a required portion of the phosphor on the anode substrate 116, resulting in desired luminous display being provided.

FIG. 13 shows a drive unit for driving a color FED in which such an FEC of the surface emission type as described above is incorporated. The FED designated at reference numeral 151 in FIG. 13 is constructed into an FED panel structure having m×n dots. Reference numeral 152 designates an image signal (image data) inputted, 153 is a signal input buffer, and 154 is a controller for generally controlling the whole panel.

The controller 154 functions to permit the image data inputted thereto through the signal input buffer 153 to be temporarily stored in a display RAM 155, for example, for each of the three primary colors red, green and blue (RGB) in each frame unit. Also, the controller 154 acts to transfer the thus-stored RGB image data to data drivers (cathode drivers) 156A and 156B depending on a display system.

The data drivers 156A and 156B output, to cathode terminals Cl to Cm, a cathode voltage Vcc inputted thereto from a cathode power supply 160B of a power supply 160 and a data pulse subjected to pulse modulation depending on a gradation of the RGB image data from the controller 154.

In this instance, the power supply 160, as described above, includes the cathode power supply 160B for applying the cathode voltage Vcc to the data drivers 156A and 156B, as well as a gate power supply 160A for applying a gate voltage Vgg of a predetermined level to a gate voltage control circuit 159.

Reference numeral 158 designates an anode power supply/anode switch circuit 158, which functions to apply an anode voltage of a predetermined level to anode terminals A1 and A2 of the FED panel 151 according to control 154 by the controller.

The gate voltage control circuit 159 has an operation order of gate terminals G1, G2, . . . of the FED panel 151 and timings thereof set therein and functions to feed a pulse voltage of a predetermined level to a scan driver (gate driver) 157 depending on the gate voltage Vgg from the gate power supply 160A.

The scan driver 157 is fed with a scan signal for scanning each of the gate terminals G1, G2, . . . of the FED panel 151 from the gate voltage control circuit 159 according to control by the controller 154. The scan driver 157 functions to drive each of picture cells arranged on the matrix according to a so-called linear sequential system for sequentially selecting the gate terminals G1, G2, . . . , depending on a display system.

In FIG. 13, cathode data of the data drivers 156A and 156B and a voltage level of the gate drive signal from the gate voltage control circuit 159 are appropriately set depending on the cathode voltage Vcc outputted from the power supply 160, so that a dynamic range of luminance in a display section may be adjusted.

As described above, the conventional field emission display (FED) is so constructed that the field emission cathode and the anode conductor provided thereon with the phosphor layer are arranged opposite to each other in the airtight envelope.

More specifically, in manufacturing of the conventional FED, the cathode conductor is formed on an inner surface of the cathode substrate constituting a part of the airtight envelope and then the insulating layer is formed on the cathode conductor, followed by formation of the gate on the insulating layer. Then, the holes are formed through the gate and insulating layer and then the emitter electrodes each are formed in each of the holes while being arranged on the cathode conductor, resulting in the FEC being provided. The anode arranged opposite to the FEC thus provided is provided by forming the light-permeable anode conductor on an inner surface of the anode substrate constituting another part of the airtight envelope and then forming the phosphor layer on the anode conductor.

In the FED thus constructed, a voltage of a suitable level is applied to each of the gate and anode conductor while applying a voltage of a predetermined level to the cathode, to thereby permit electrons to be emitted from a distal end of the emitter electrodes. Then, the electrons thus emitted impinge on a desired portion of the phosphor layer of the anode, leading to luminescence of the phosphor, which is externally observed through the anode conductor and anode substrate.

Unfortunately, the conventional FED constructed as described above causes the emitter electrodes to be polluted during mounting of the FEC structure in the airtight envelope, resulting in an emission threshold level of the emitter electrodes being increased, leading to a reduction in emission characteristics thereof or a deterioration in long-term reliability of luminous efficiency of the phosphor.

This would be due to the fact that the emitter electrodes and the phosphor layer of the anode electrode are oxidized by $O_2$ or polluted with C or the like adhered thereto. Such oxidation or pollution is increased with a lapse of operation time. For example, with regard to an affection of the oxidation or contamination to emission performance of the emitter electrodes, an anode current is caused to be rapidly reduced due to the affection as shown in FIG. 14, resulting in luminance characteristics of the phosphor layer being rapidly deteriorated.

In view of the foregoing, the assignee proposed techniques of cleaning emitter electrodes by irradiation of electron beams during manufacturing of an FED, as disclosed in Japanese Patent No. 2,634,295. The techniques proposed are constructed so as to impinge a part of electrons emitted from emitter electrodes on non-emitting emitter electrodes which are kept from emitting electrons, leading to cleaning thereof.

For this purpose, the emitter electrodes are electrically classified into a plurality of pairs of emitter electrode groups. When the emitter electrodes of one of the groups in each pair is under the normal conditions of emitting electrons, a positive potential of a level equal to or higher than that of a gate of the emitter electrodes of the one group is applied to the emitter electrodes of the other group. Such drive conditions are alternately changed over for every emitter electrode groups in each pair. This permits a part of electrons emitted from the emitter electrodes of one of the groups in each pair to impinge on the emitter electrodes of the other group to clean them. Similarly, electrons emitted from the emitter electrodes of the other group impinge on the emitter electrodes of the one group, to thereby clean them.

However, the techniques of cleaning the emitter electrodes by irradiation of emitted electrons thereon fail to satisfactorily ensure emission characteristics of the FED having a narrow gap and luminous efficiency of the phosphor layer.

Also, driving of the emitter electrodes while dividing them into a plurality of groups not only requires to electrically divide the cathode conductor for the emitter electrodes, but requires individual drive circuits.

SUMMARY OF THE INVENTION

The present invention has been made in view of the foregoing disadvantage of the prior art.

Accordingly, it is an object of the present invention to provide a cold cathode electronic device which is capable of removing pollution of emitter electrodes during manufacturing of the device, to thereby prevent a deterioration in emission characteristics of the emitter electrodes, as well as a deterioration in luminous efficiency of a phosphor layer.

It is an object of the present invention to provide a field emission luminous device which is capable of removing pollution of emitter electrodes during manufacturing of the device, to thereby prevent a deterioration in emission characteristics of the emitter electrodes and a deterioration in luminous efficiency of a phosphor layer.

It is a further object of the present invention to provide a cold cathode luminous device which is capable of removing pollution of emitter electrodes during manufacturing of the device, to thereby prevent a deterioration in emission characteristics of the emitter electrodes and a deterioration in luminous efficiency of a phosphor layer.

In order to attain the above-described objects, the present invention is so constructed that hydrogen occlusion metal is included in at least a part of at least any one of a gate electrode and an anode electrode and a part of electrons field-emitted is impinged on the hydrogen occlusion metal to activate it, to thereby permit the hydrogen occlusion metal to discharge hydrogen. The hydrogen thus discharged functions to prevent pollution of emitter electrodes and a phosphor layer.

The hydrogen occlusion metal referred to herein means metal or alloy which cooperates with hydrogen to form a hydrogenated material. The hydrogen is stored between crystal lattices of the metal. The amount of hydrogen stored is known to be hundreds of times as volume as the metal. Elements for a matrix of the hydrogen occlusion metal include Nb, Zr, V, Fe, Ta, Ni, Ti, Mg, Th or a combination thereof.

Thus, in the present invention, for example, supposing that the emitter electrode or phosphor layer has $O_2$ gas and C adhered to a surface thereof, hydrogen gas discharged from the hydrogen occlusion metal effectively removes $O_2$ gas and C, because it reacts with the $O_2$ gas and C to form OH and CH, respectively. Also, the residue gas reacts directly with hydrogen, resulting in $O_2$ gas an C adhered being effectively reduced.

In accordance with one aspect of the present invention, a cold cathode electronic device is provided. The cold cathode electronic device includes a cathode electrode for field-emitting electrons, a gate electrode, and an anode electrode. The electrons field-emitted from the cathode electrode are permitted to reach at least any one of the gate electrode and anode electrode at the time when a gate voltage is applied between the gate electrode and the cathode electrode and an anode voltage is applied between the cathode electrode and the anode electrode. At least a part of at least any one of the gate electrode and anode electrode includes hydrogen occlusion metal.

Also, in accordance with this aspect of the present invention, a cold cathode electronic device is provided. The cold cathode electronic device includes a cathode electrode for field emitting electrons, a gate electrode, and an anode electrode. The electrons field-emitted from the cathode electrode are permitted to reach at least any one of the gate electrode and anode electrode at the time when a gate voltage is applied between the gate electrode and the cathode electrode and an anode voltage is applied between the cathode electrode and the anode electrode. At least a part of at least any one of the gate electrode and anode electrode includes hydrogen occlusion metal. The cold cathode electronic device also includes a control unit for varying a drive signal fed to any electrode selected from the cathode electrode, gate electrode and anode electrode. The drive signal varied by the control unit permits the amount of electrons emitted to be controlled by controlling a current of any electrode selected from the gate electrode and anode electrode, so that the electrons controlled are impinged on the hydrogen occlusion metal to discharge hydrogen gas therefrom.

In a preferred embodiment of the present invention, the drive signal fed to any electrode selected from the cathode electrode, gate electrode and anode electrode is a pulse signal, wherein a variation of the pulse signal is a variation in any one selected from the group consisting of a pulse width of the pulse signal, a pulse height thereof and the number of pulses thereof.

In a preferred embodiment of the present invention, the pulse signal is varied in correspondence to a variation in an anode current of the anode electrode detected.

In a preferred embodiment of the present invention, when the anode current is reduced, a current of the electrode of which at least a part includes the hydrogen occlusion metal is increased to increase discharge of hydrogen gas from the hydrogen occlusion metal, to thereby enhance electron emission of the cathode electrode; and when the anode current is increased, a current of the electrode of which at least a part includes the hydrogen occlusion metal is reduced to reduce discharge of hydrogen gas from the hydrogen occlusion metal, to thereby stabilize electron emission of the cathode electrode.

In a preferred embodiment of the present invention, the hydrogen occlusion metal is selected from the group consisting of Nb, Zr, V, Fe, Ta, Ni and Ti.

In a preferred embodiment of the present invention, the hydrogen occlusion metal occludes $CH_4$ gas as well as the hydrogen gas and discharges $CH_4$ gas as well as the hydrogen gas due to impingement of the electrons thereon.

In accordance with another aspect of the present invention, a field emission luminous device is provided. The field emission luminous device includes a cathode electrode including emitter electrodes for field-emitting electrons, a gate electrode, and an anode electrode including a phosphor layer for emitting light due to impingement of the electrons thereon. The electrons field-emitted from the cathode electrode are permitted to impinge on the anode electrode, leading to luminescence of the phosphor layer. At least a part of the gate electrode includes hydrogen occlusion metal. The anode electrode is applied thereto a voltage lower than an electron drawing voltage applied to the gate electrode at the time of luminescence of the phosphor layer under the conditions that a voltage is kept applied to the anode electrode or the gate electrode is applied thereto an electron drawing voltage while a voltage is kept from being applied to the anode electrode in response to switching of the anode electrode. The hydrogen occlusion metal has the field-emitted electrons impinged thereon during non-luminescence of the phosphor layer, resulting in hydrogen gas being discharged from the hydrogen occlusion metal.

In accordance with this aspect of the present invention, a field emission luminous device is provided. The field emission luminous device includes a cathode electrode including emitter electrodes for field-emitting electrons, a gate electrode, and an anode electrode including a phosphor layer for emitting light due to impingement of the electrons thereon. The electrons field-emitted from the cathode electrode are permitted to impinge on the anode electrode, leading to luminescence of the phosphor layer. The anode electrode includes a display anode electrode including the phosphor layer and a hydrogen discharge anode electrode which is electrically separated from the display anode electrode and free of the phosphor layer and of which at least a part includes hydrogen occlusion metal. The hydrogen discharge anode electrode is fed with a drive signal independent from that of the display anode electrode. The hydrogen occlusion metal of the hydrogen discharge anode electrode has the field-emitted electrons impinged thereon, to thereby discharge hydrogen gas therefrom.

Further, in accordance with this aspect of the present invention, a field emission luminous device is provided. The field emission luminous device includes a cathode electrode including emitter electrodes for field-emitting electrons, a gate electrode, and an anode electrode including a phosphor layer for emitting light due to impingement of the electrons thereon. The electrons field-emitted from the cathode electrode are permitted to impinge on the anode electrode, leading to luminescence of the phosphor layer. At least a part of the gate electrode includes hydrogen occlusion metal. The field emission luminous device also includes a focusing electrode arranged between the gate electrode and the anode electrode and has a voltage applied thereto. The voltage applied to the focusing electrode is controlled to vary a rate of distribution of a current fed to the gate electrode and anode electrode, so that a required amount of electrons may be impinged on the hydrogen occlusion metal of the gate electrode to discharge a required amount of hydrogen gas from the hydrogen occlusion metal.

In accordance with a further aspect of the present invention, a cold cathode luminous device is provided. The cold cathode luminous device includes a cathode conductor, a cold cathode arranged on the cathode conductor so as to emit electrons, an anode conductor, and a phosphor layer arranged on the anode conductor. The electrons emitted from the cold cathode are impinged on the phosphor layer, leading to luminescence of the phosphor layer. The phosphor layer has a hydrogen occlusion metal powder added thereto.

In a preferred embodiment of the present invention, the hydrogen occlusion metal powder is adhered to a surface of the phosphor layer or a surface of a phosphor particle constituting the phosphor layer.

In a preferred embodiment of the present invention, the phosphor layer is formed of a paste made by mixing a phosphor particle and the hydrogen occlusion metal powder with each other.

In a preferred embodiment of the present invention, the phosphor layer is constituted of a phosphor powder of 1 to 10 $\mu$m in particle size and the hydrogen occlusion metal powder has a particle size of 0.01 to several $\mu$m.

Moreover, in accordance with this aspect of the present invention, a cold cathode luminous device is provided. The cold cathode luminous device includes a cold cathode conductor for field-emitting electrons, an anode conductor, a phosphor layer arranged on the anode conductor so as to emit light due to impingement of the electrons thereon, and an airtight envelope in which the cold cathode, anode conductor and phosphor layer are received. The envelope has hydrogen gas encapsulated therein. The phosphor layer has a hydrogen occlusion metal powder added thereto.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference characters designate like or corresponding parts throughout; wherein.

DETAILED DESCRIPTION OF THE PREFERRED EMBODIMENTS

Now, the present invention will be described hereinafter with reference to FIGS. 1 to 11.

Figure 1:
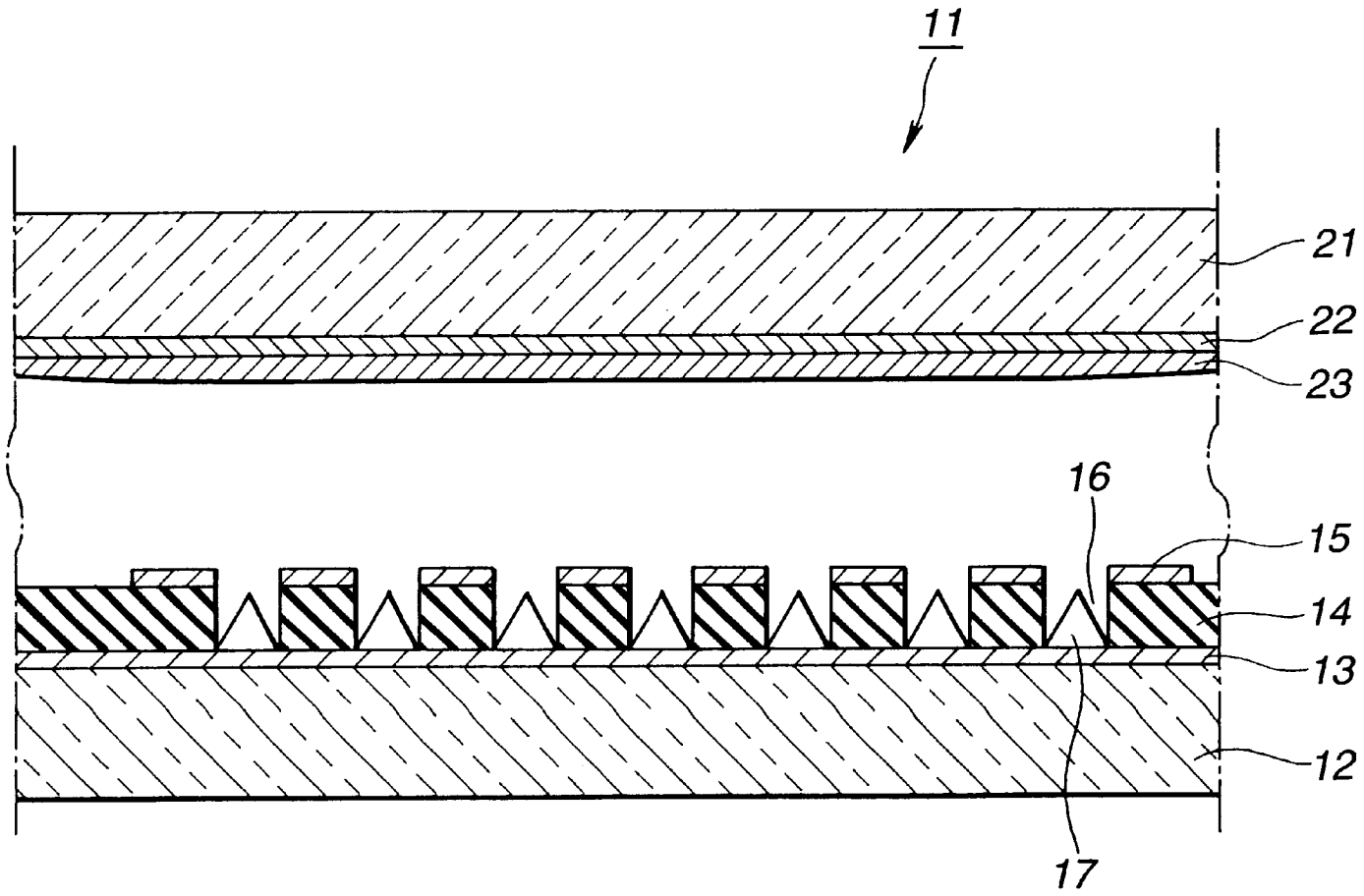
FIG. 1 is a fragmentary enlarged sectional view schematically showing an embodiment of a field emission luminous device according to the present invention which includes a cold cathode electronic device according to the present invention.

Referring first to FIG. 1, an embodiment of a field emission luminous device according to the present invention which includes a cold cathode electronic device according to the present invention is illustrated. A field emission electronic device of the illustrated embodiment generally designated at reference numeral 11 which is in the category of a cold cathode electronic device includes an insulating cathode substrate 12. The insulating cathode substrate 12 is formed on an inner surface thereof with one or more cathode electrodes (cathode conductors) 13, which are then formed thereon with an insulating layer 14 and one or more gate electrodes 15 in order. In the illustrated embodiment, the gate electrodes 15 each have a layer of hydrogen occlusion metal or alloy formed, carried or coated on at least a part thereof. The hydrogen occlusion layer may be made of metal or alloy selected from the group consisting of Nb, Zr, V, Fe, Ta, Ni, Ti and the like.

The gate electrodes 15 and insulating layer 14 are formed with a plurality of holes 16 in a manner to commonly extend therethrough. The holes 16 each are provided therein with an emitter electrode 17 of a conical configuration in vertical section while being arranged on a portion of the cathode electrode exposed through the hole 16, so that the emitter electrodes 17 each are exposed at an acute distal end thereof through the hole 16. In the illustrated embodiment, the cathode electrodes 13 and gate electrodes 15 are formed into a stripe-like shape and arranged so as to perpendicular to each other, resulting in cooperating with each other to constitute a matrix for dot display.

The field emission luminous device of the illustrated embodiment also includes a light-permeable anode substrate 21 arranged so as to be spaced at a predetermined interval from the cathode substrate 12. The anode substrate 21 is formed on an inner surface thereof with an anode electrode 22, which is then formed thereon with a phosphor layer 23. In the illustrated embodiment, the anode electrode 22 is arranged all over the anode substrate 21 and the phosphor layer 23 is arranged all over the anode electrode 22.

In the illustrated embodiment, the cathode substrate 12 and anode substrate 21 each constitute a part of an airtight casing of which a closed airtight envelope is formed.

Figure 2A:
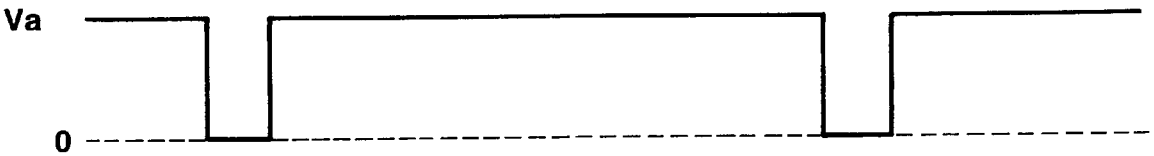
FIGS. 2A, 2B, 2C are waveform diagrams showing a waveform of a drive signal of each of electrodes in the field emission luminous device of FIG. 1.
Figure 2B:
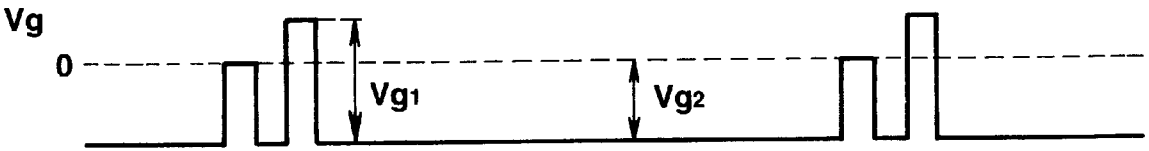
Figure 2C:
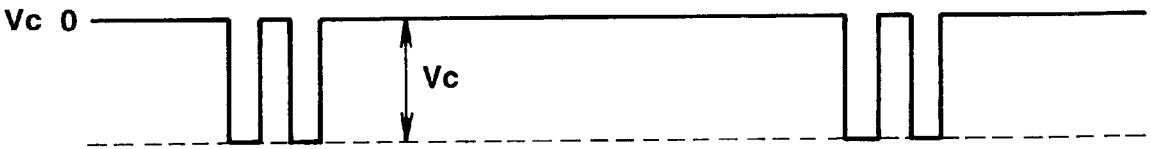

FIGS. 2A–C show a waveform of a drive signal of each of the electrodes incorporated in the field emission luminous device 11 of the illustrated embodiment. In the illustrated embodiment, the anode electrode 22 is kept fed with a drive signal Va during turning-on of the field emission luminous device 11. Under such conditions, any one of the cathode electrodes 13 or the gate electrodes 15 is scanned in order and the other of the electrodes is fed with a drive signal in synchronism with the scanning, resulting in one of intersections on the matrix being selected.

More particularly, for example, the cathode electrodes 13 are scanned in order by means of a drive signal Vc and a required one of the gate electrodes 15 is selected. Then, the selected gate electrode 15 is fed with a drive signal Gg1, to thereby select one of the intersections. The emitter electrode 17 on the thus-selected intersection field-emits electrons, which are permitted to impinge on a portion of the anode electrode 22 positioned opposite to the intersection, resulting in a portion of the phosphor layer 23 which corresponds to the portion of the anode electrode 22 emitting light.

In the illustrated embodiment, an anode current fed to the anode electrode 22 is constantly monitored by a control means (not shown); so that when the anode current is decreased to a level lower than a predetermined voltage level, gas mainly containing hydrogen is discharged from the hydrogen occlusion metal on the gate electrode 15, to thereby restore emission of the emission electrode 17.

More particularly, as shown in FIGS. 2A–C, during turning-off of the field emission luminous device 11 wherein the anode electrode 22 is kept from being fed with the drive signal Va, resulting in a voltage applied being zero, the gate electrodes 15 are fed with a drive signal Vg2. The drive signal Vg2 has a voltage set to be lower than that of the drive signal Vg1 during the turning-on. Thus, the anode current is at a zero potential during the turning-on, so that a sufficient amount of current is fed to the gate electrodes 15 even when the voltage applied to the gate electrodes 15 is lower than the voltage of the drive signal Vg1 during the turning-on.

Thus, when electrons emitted from the emitter electrode 17 are impinged on the hydrogen occlusion metal on the gate electrode 15, the hydrogen occlusion metal is activated, to thereby discharge hydrogen and/or $CH_4$ in proximity to the emitter electrode 17. The thus-discharged gas functions to remove $O_2$ gas and C adhered to the emitter electrode 17 therefrom, to thereby prevent an increase in work function of the emitter electrode 17, resulting in restoring emission characteristics of the emitter electrode 17. This ensures increased durability and reliability of the emitter electrode 17. The gas discharged also acts to improve luminous efficiency of the phosphor layer 23.

The illustrated embodiment is so constructed that discharge of gas such as hydrogen or the like from the hydrogen occlusion metal is prevented unless the anode current is reduced below a predetermined voltage level. In other words, impingement of electrons on the hydrogen occlusion metal of the gate electrode 15 for the discharge is carried out when it is confirmed that the anode current is decreased below the level. Alternatively, the illustrated embodiment may be so constructed that the voltage applied to the gate electrode 15 is increased in a step-like manner with a decrease in anode current, resulting in a rate at which hydrogen is discharged from the hydrogen occlusion metal being gradually increased.

Figure 3:
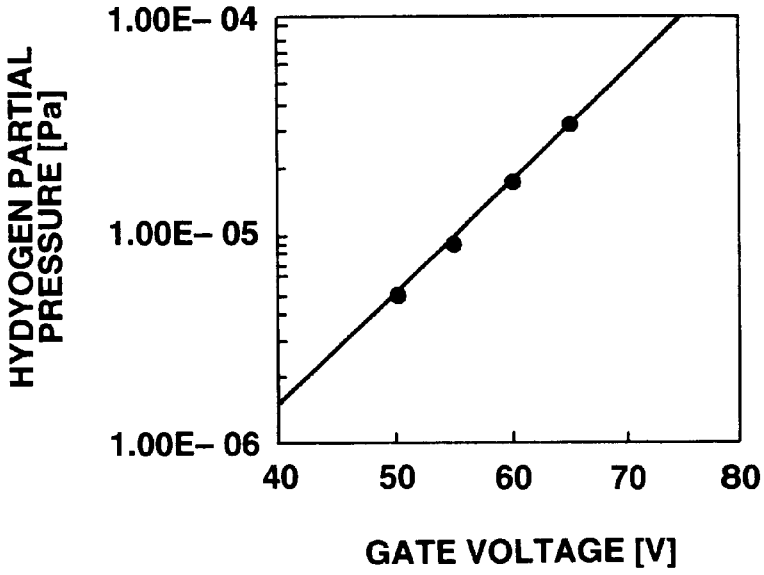
FIG. 3 is a graphical representation showing relationship between a gate voltage and a hydrogen partial pressure in an airtight envelope in the field emission luminous device of FIG. 1.
Figure 4:
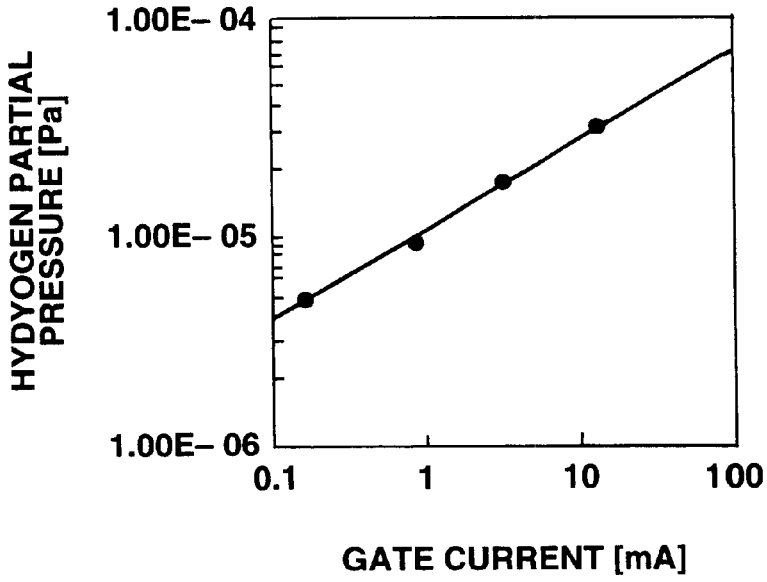
FIG. 4 is a graphical representation showing relationship between a gate current and a hydrogen partial pressure in an airtight envelope in the field emission luminous device of FIG. 1.

FIG. 3 shows relationship between the gate voltage and a hydrogen partial pressure in the airtight envelope in the field emission luminous device 11 and FIG. 4 shows relationship between the gate current and the hydrogen partial pressure.

Relationship between the gate voltage and current and the hydrogen partial pressure required to restore performance of the emitter electrode 17 and the like may be previously determined by an experiment or the like and stored as one of control conditions in a control means (not shown). Thus, the gate drive signal is varied with a reduction in luminance of the phosphor layer 23 or a reduction in anode current, so that control of the hydrogen partial pressure permits control for restoring emission characteristics of the anode electrode 22 and control for stabilizing luminous efficiency of the phosphor layer to be attained automatically or efficiently.

Figure 5:
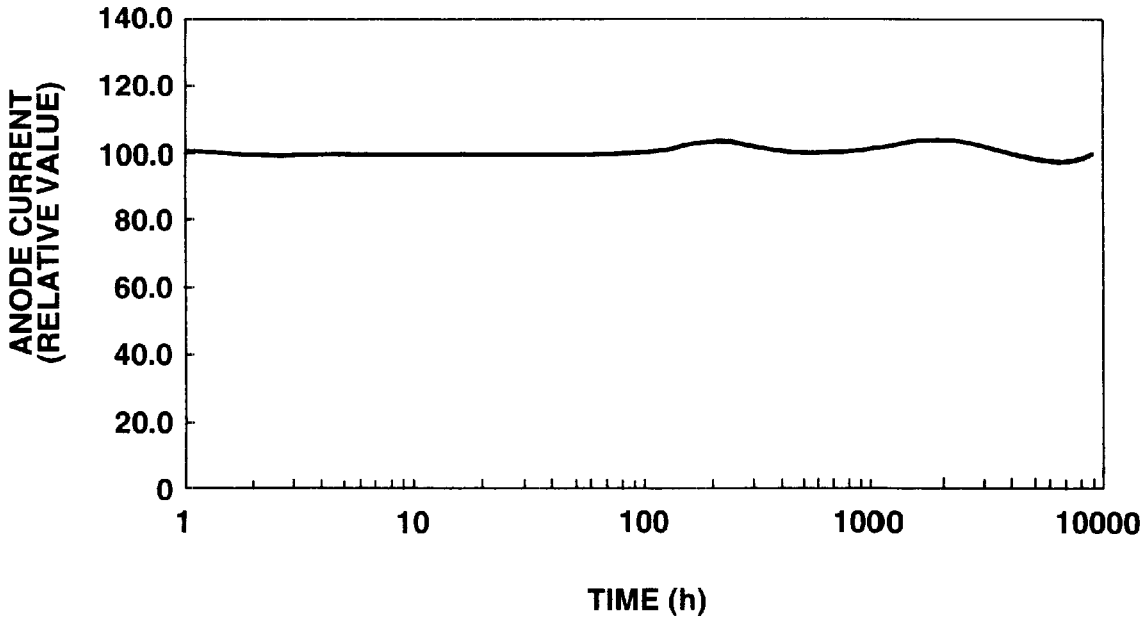
FIG. 5 is a graphical representation showing relationship between a relative value of an anode current and continuous lighting time in the field emission luminous device of FIG. 1.

FIG. 5 shows relationship between continuous lighting time and a relative value of an anode current indicating emission performance of the emitter electrode 17 and therefore life characteristics of the emitter electrode 17 in the illustrated embodiment.

In the field emission luminous device 11 of the illustrated embodiment, when a reduction in luminance of the phosphor layer 23 or a reduction in anode current is detected during turning-on of the device 11, electrons are suitably impinged on the gate electrode 11 depending on the reduction, to thereby permit discharge of gas such as hydrogen or the like. This substantially restrains a deterioration in emission characteristics of the emitter element 17 and luminous characteristics of the phosphor layer 23, so that the anode current may be kept at a level of an initial set value over a long period of time. This permits luminance of the phosphor layer 23 to be relatively stabilized without being substantially varied while being kept at an initial set value, resulting in the phosphor layer 23 exhibiting increased life characteristics.

In the illustrated embodiment, a variation in drive signal with respect to the gate electrode 15 may be readily attained by varying at least one of a pulse signal width of a pulse-like drive signal applied, a pulse height thereof, the number of pulses thereof and the like.

Also, in the illustrated embodiment, at least a part of the gate electrode 15 is formed of hydrogen occlusion metal or alloy. The hydrogen occlusion metal or alloy may be formed into any desired configuration. For example, a layer of the hydrogen occlusion alloy may be formed on the gate electrode 15. Alternatively, the hydrogen occlusion material may be attached to the gate electrode 15.

Thus, the illustrated embodiment varies a distribution ratio of anode current/gate current between turning-on of the device and turning-off thereof, to thereby permit the emitter electrode 17 to be stably driven.

Figure 6:
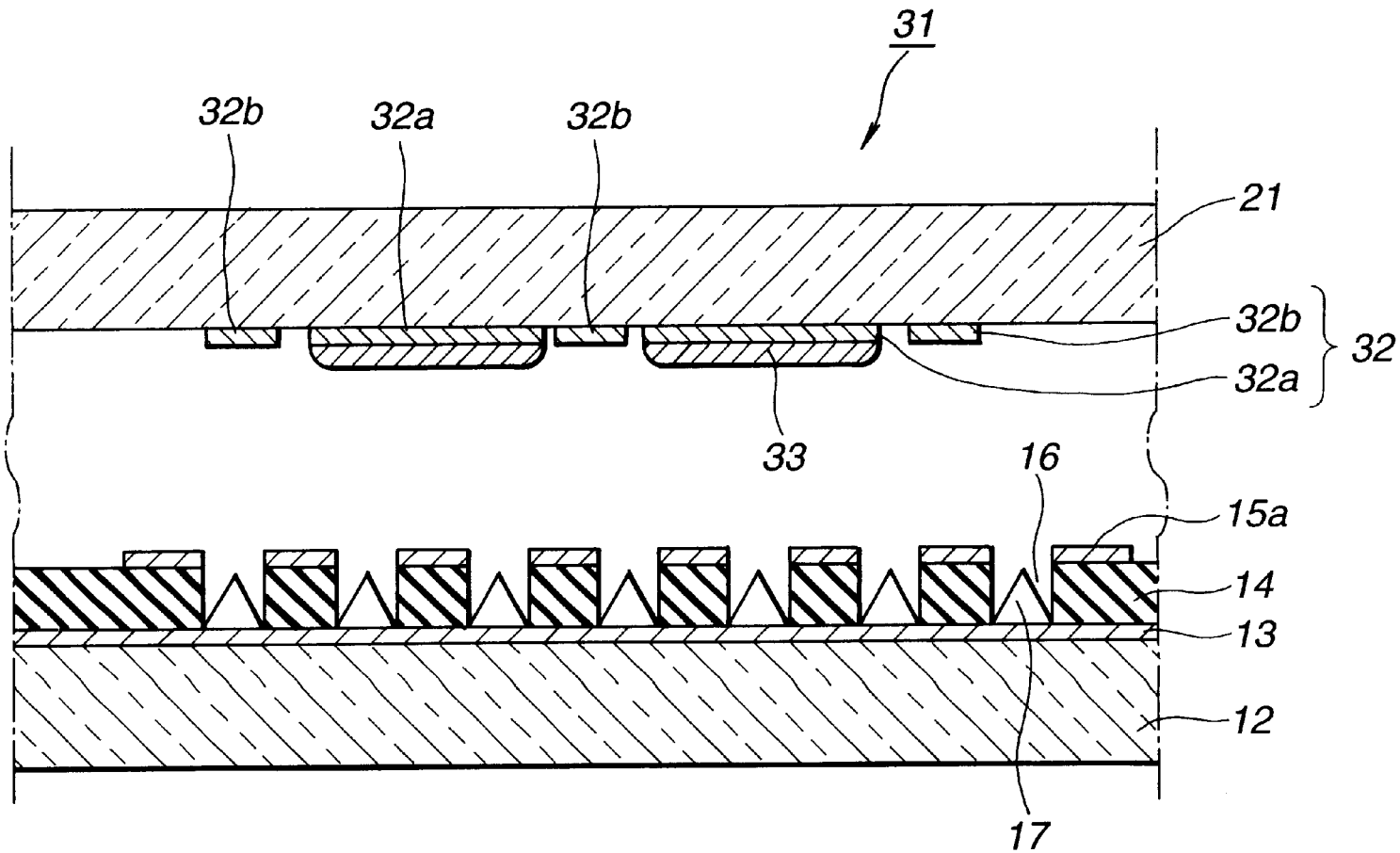
FIG. 6 is a fragmentary enlarged sectional view schematically showing another embodiment of a field emission luminous element according to the present invention which includes a cold cathode electronic device according to the present invention.

Referring now to FIG. 6, a second embodiment of a field emission luminous device according to the present invention which includes a cold cathode electronic device according to the present invention is illustrated. In a field emission luminous device of the second embodiment, gate electrodes 15*a* each do not include such hydrogen occlusion alloy as described above. Also, anode electrodes include first anode electrodes 32*a* for display and second anode electrodes 32*b* for hydrogen discharge which are formed into a stripe-like configuration and electrically separated from each other. The first display anode electrodes 32*a* each are formed thereon with a phosphor layer 33. The second hydrogen discharge anode electrodes 32*b* each do not include such a phosphor layer but are formed at at least a part thereof of hydrogen occlusion alloy or provided on a part of an upper surface thereof with hydrogen occlusion alloy. The hydrogen discharge anode electrodes 32*b* are arranged in proximity to the display anode electrodes 32*a* so as to interpose each of the display anode electrodes 32*a* therebetween.

In the illustrated embodiment, the display anode electrodes 32*a* and hydrogen discharge anode electrodes 32*b* are rendered electrically independent from each other, to thereby fed with drive signal or control signal independently from each other.

Thus, the illustrated embodiment permits the hydrogen discharge anode electrode 32*b* to be fed with a drive signal independently from the display anode electrode 32*a*, to thereby discharge hydrogen therefrom, resulting in exhibiting substantially the same function and advantage as the first embodiment described above. Also, the hydrogen discharge anode electrodes 32*b* may be fed with a drive signal irrespective of display operation of the device or non-display operation thereof. In addition, a potential of the drive signal may be varied with time or the anode electrodes 32*b* may be fed with a potential different from that of the anode electrodes 32*a*. This results in electrons being impinged on a desired portion of the hydrogen occlusion alloy.

Figure 7:
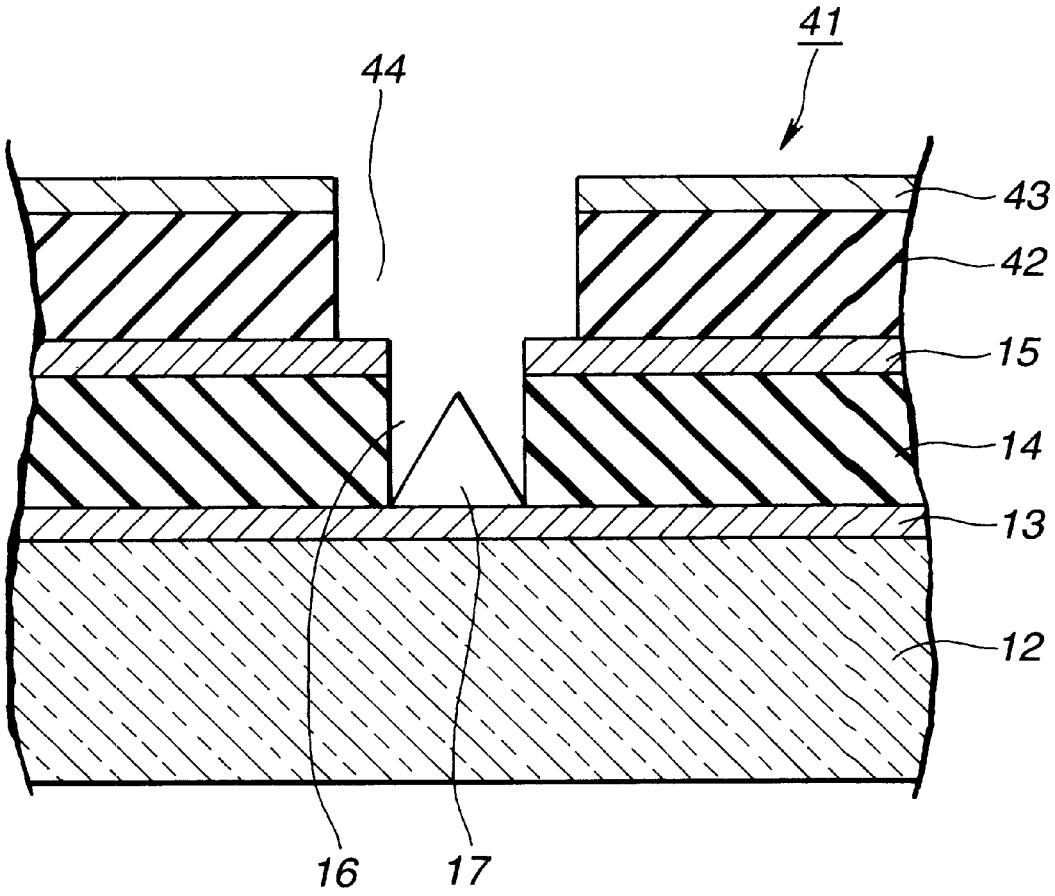
FIG. 7 is a fragmentary enlarged sectional view schematically showing a further embodiment of a field emission luminous element according to the present invention which includes a cold cathode electronic device according to the present invention.

Referring now to FIG. 7, a third embodiment of a field emission luminous device according to the present invention which includes a cold cathode electronic device according to the present invention is illustrated. In a field emission luminous device of the third embodiment generally designated at reference numeral 41 as well, an airtight envelope and FECs may be constructed in substantially the same manner as those in the first and second embodiments described above.

In the illustrated embodiment, gate electrodes 15 each of which is at least partially formed of hydrogen occlusion alloy are provided thereon with a second insulating layer 42 and a focusing electrode 43 in order. The second insulating layer 42 and focusing electrode 43 are formed with second holes 44 in a manner to commonly extend therethrough and communicate with holes 16, resulting in providing a double gate structure.

The double gate structure in the illustrated embodiment which is constructed by adding the focusing electrode 43 to the FEC structure permits a ratio between a gate current and an anode current to be varied as desired by adjusting a potential applied to the focusing electrode 43.

More particularly, a ratio of electrons flowing into the gate electrode 15 without reaching an anode substrate 22 to all electrons field-emitted from an emitter electrode 17 may be controlled by means of a potential of the focusing electrode 43. The electrons flowing into the gate electrode 16 activate hydrogen occlusion metal, to thereby permit hydrogen or the like to be discharged therefrom in the envelope.

The third embodiment thus constructed is advantageously applied to a high-voltage tube wherein on/off operation of an anode voltage does not take place during driving thereof due to an increase in anode voltage.

Figure 8:
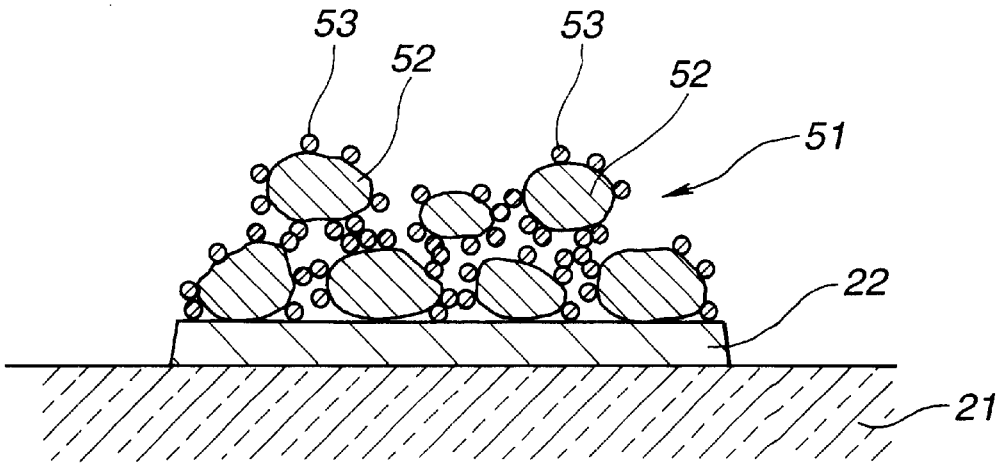
FIG. 8 is a fragmentary enlarged sectional view schematically showing a phosphor layer incorporated in an embodiment of a cold cathode electronic device according to the present invention.

Referring now to FIG. 8, a phosphor layer in an embodiment of a cold cathode luminous device according to the present invention is illustrated. A cold cathode luminous device of the illustrated embodiment may be constructed in substantially the same manner as the embodiments described above, therefore, the following description on the illustrated embodiment will be made in connection with a phosphor layer formed on a light-permeable anode conductor of the cold cathode luminous device, which has hydrogen occlusion metal incorporated therein.

The cold cathode luminous device of the illustrated embodiment includes an anode substrate 21 made of a light-permeable insulating material, anode conductors 22 made of a light-permeable material and selectively arranged on the anode substrate 21 and a phosphor layer 51 formed on each of the anode conductors 22.

The phosphor layer 51 is formed of phosphor particles 52 having hydrogen occlusion metal powders 53 adhered thereto. The hydrogen occlusion metal or material may be selected from the group consisting of Nb, Zr, V, Fe, Ta, Ni, Ti, Mg, Th, a combination thereof and the like. Also, hydrogenated zirconium, hydrogenated vanadium and the like may be likewise used for this purpose. The phosphor particle 52 has a particle size within a range of 1 to 10 $\mu$m and the hydrogen occlusion metal powder 53 has a particle size within a range of 0.01 to several $\mu$m. Zr or V is a non-luminous substance. Thus, Zr or V are arranged so as not to cover a whole surface of the phosphor layer 52. In other words, Zr is not arranged in the form of a film on the surface of the phosphor layer 52. Rather, the Zr powder and therefore the hydrogen occlusion metal powder 53 is adhered in the form of a particle to the phosphor particle 52. The amount of hydrogen occlusion metal powder 53 added is adjusted so as to permit luminescence of the phosphor layer to be satisfactorily observed from the outside.

Thus, the FED constructed as described above permits electrons field-emitted from an emitter electrode 17 to be impinged on the anode conductor 22, leading to luminescence of the phosphor layer 51, which is externally observed through the light-permeable anode conductor 22 and anode substrate 21.

Also, electrons emitted from the emitter electrode 17 are concurrently impinged on the hydrogen occlusion metal powder 53, so that hydrogen gas may be discharged therefrom. The hydrogen gas thus discharged not only improves luminous efficiency of the phosphor particle 53, but affects the emitter electrode 17, to thereby remove $O_2$ and C adhered to a distal end of the emitter therefrom by cleaning, leading to an increase in work function in field emission of electrons from the emitter, resulting in improving emission characteristics thereof.

Figure 9:
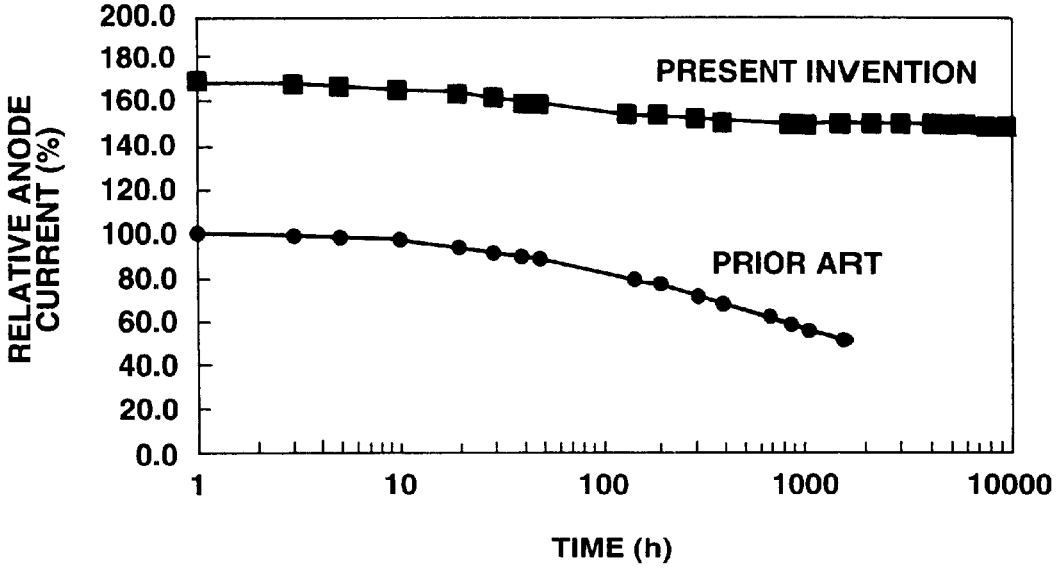
FIG. 9 is a graphical representation showing results of a life test carried out on each of the field emission luminous device shown in FIG. 8 and a conventional one while comparing the results with each other.

FIG. 9 shows results of a life test carried out on each of the cold cathode luminous device of the illustrated embodiment and the conventional cold cathode luminous device. As will be noted from FIG. 9, the conventional device is decreased in life to a level below 80% of an initial value when continuous light time exceeds about 100 hours. On the contrary, the device of the illustrated embodiment has an initial value increased by about 80% as compared with the conventional one. Also, the device of the illustrated embodiment restrains a reduction in life with lapse of time as compared with the conventional one. More specifically, a decrease in life in the device of the illustrated embodiment is as low as about 10% even after continuous lighting time exceeds 10000 hours.

Figure 10:
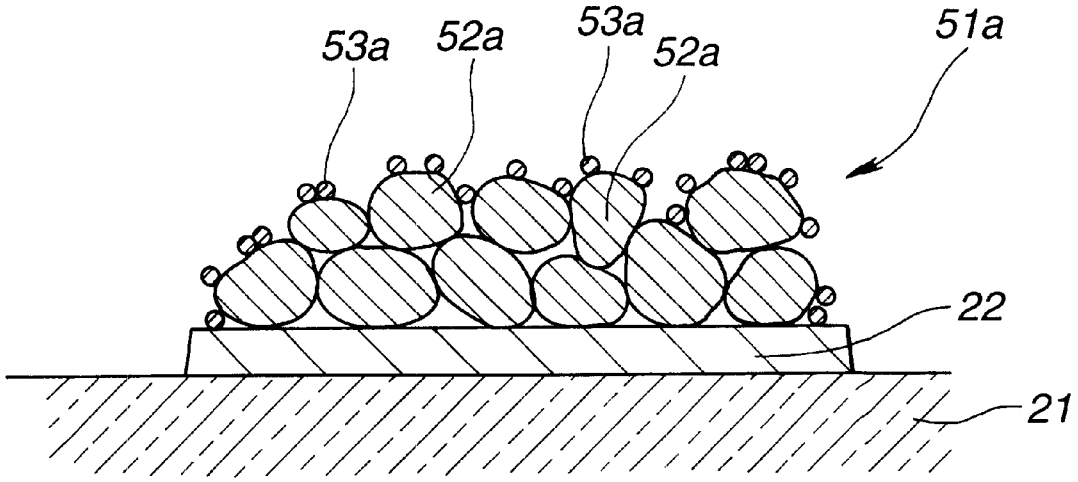
FIG. 10 is a fragmentary enlarged sectional view schematically showing a modification of the phosphor layer of FIG. 8.

Referring now to FIG. 10, a phosphor layer in another embodiment of a cold cathode luminous device according to the present invention is illustrated.

In a cold cathode luminous device of the illustrated embodiment, a phosphor layer 51*a* is formed by forming phosphor particles 52*a* in the form of a layer on each of anode conductors 22 and then adhering hydrogen occlusion metal powders 53*a* on the phosphor particles 52*a*.

The hydrogen occlusion metal powder 53 is inherently a non-luminous substance. Thus, in the illustrated embodiment, the phosphor layer 51*a* is first formed, followed by adhesion of the hydrogen occlusion metal powder 53*a* thereto, so that observation of luminescence of the phosphor through the anode conductor 22 may be satisfactorily carried out without any difficulty. Thus, the hydrogen occlusion metal powder 53*a* is kept from interrupting observation of display. The remaining part of the illustrated embodiment may be constructed in substantially the same manner as the embodiment described above.

Adhesion of the hydrogen occlusion metal powders 53*a* to the surface of the phosphor particles 52*a* of the phosphor layer 51*a* may be carried out, for example, by dispersing the Zr powders 53*a* in an organic solvent to prepare a dispersion and spraying the dispersion onto the phosphor particles 52*a*.

Figure 11:
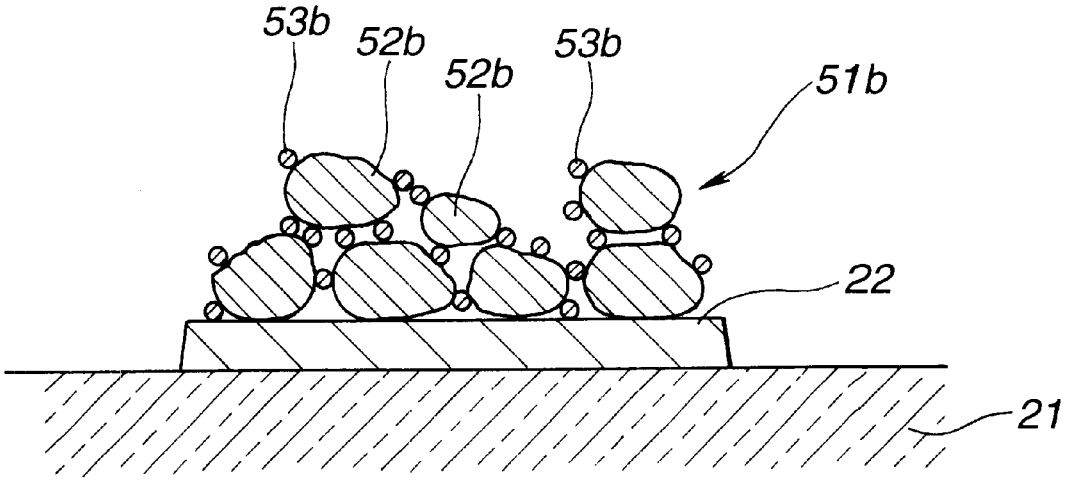
FIG. 11 is a fragmentary enlarged sectional view schematically showing another modification of the phosphor layer of FIG. 8.
Figure 12:
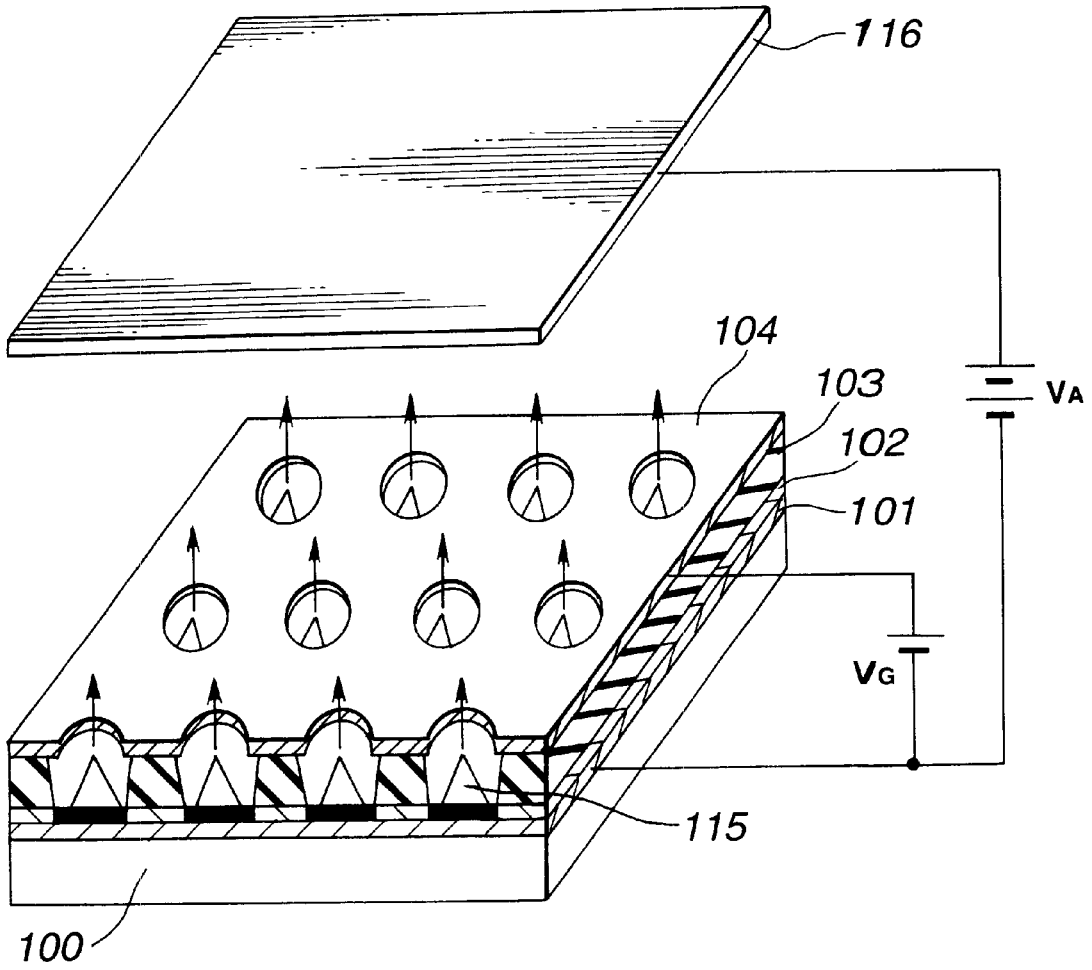
FIG.12 PRIOR ART
FIG. 12 is a perspective sectional view schematically showing a conventional field emission luminous device.
Figure 13:
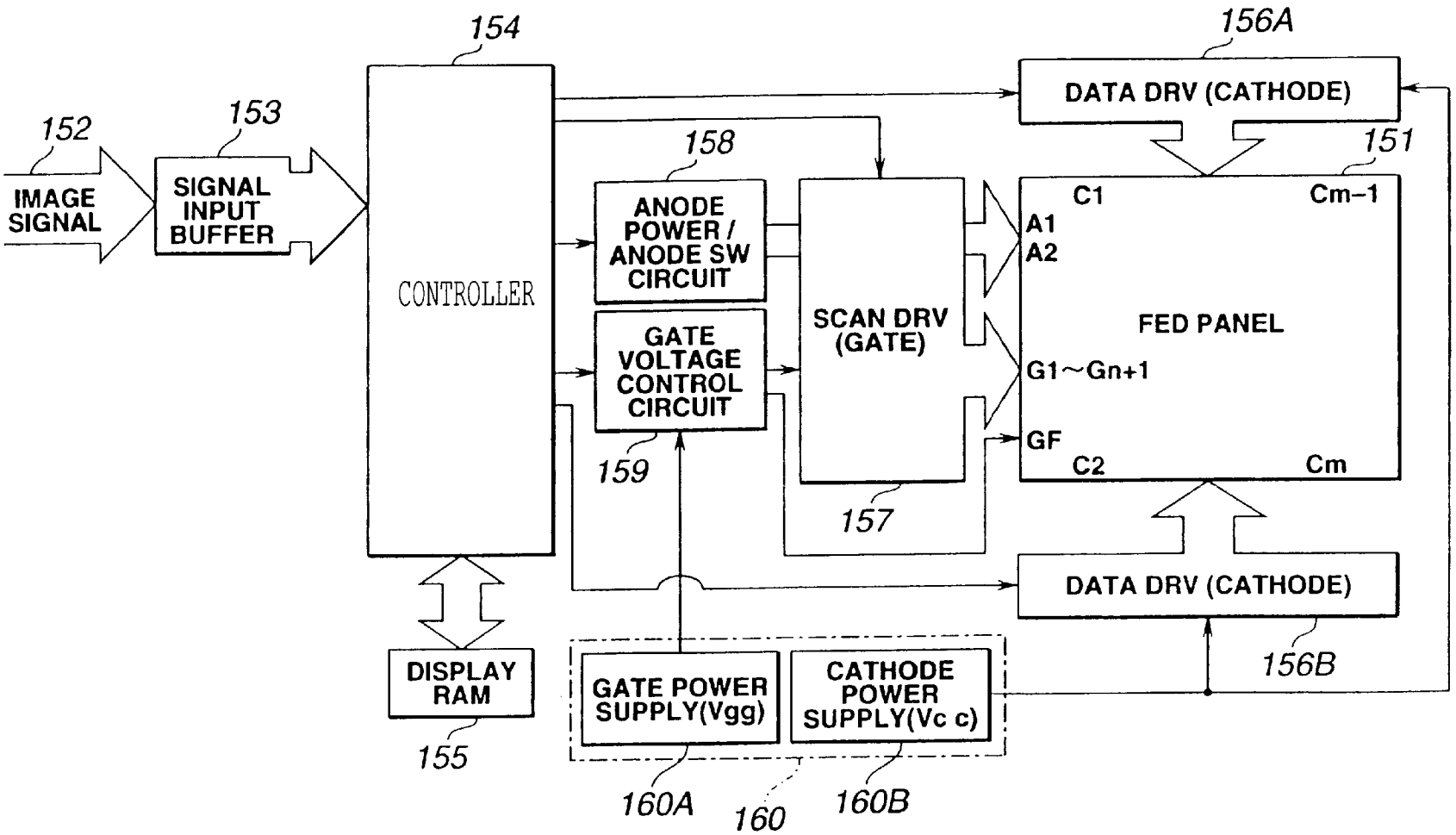
FIG.13 PRIOR ART
FIG. 13 is a block diagram showing a drive unit section of the conventional field emission luminous device of FIG. 12.
Figure 14:
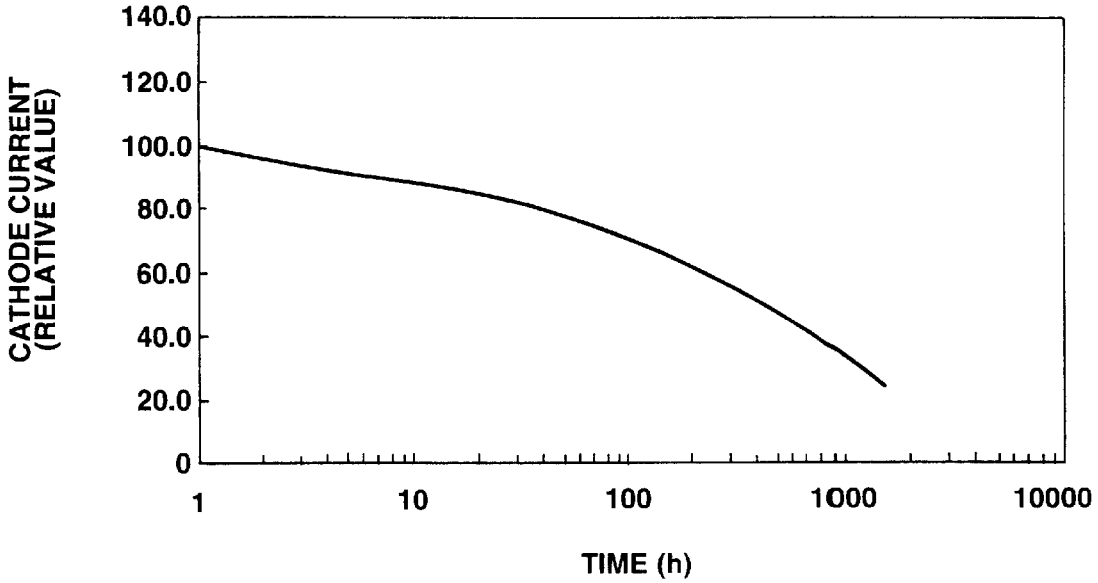
FIG.14 PRIOR ART
FIG. 14 is a graphical representation showing relationship between a relative value of an anode current and continuous lighting time in the conventional field emission luminous device of FIG. 12.

Referring now to FIG. 11, a phosphor layer in a further embodiment of a cold cathode luminous device according to the present invention is illustrated. In a cold cathode luminous device of the illustrated embodiment, a phosphor layer 51*b* is made of a paste-like mixture prepared by phosphor particles 52*b* with hydrogen occlusion metal powders 53*b*. More particularly, for example, the powders 53*b* of Zr or $ZrH_2$ which is the hydrogen occlusion metal are fully dispersed in a solvent to prepare a dispersion and then the phosphor particles 52*b* are dispersed in the dispersion, to thereby prepare a paste. Then, the paste is deposited in a predetermined pattern on an anode conductor 22 by printing, slurry techniques, electrodeposition or the like, to thereby obtain the phosphor layer 51*b*.

The hydrogen occlusion material is essentially a non-luminous substance, therefore, the amount of mixing of the hydrogen occlusion material and dispersibility thereof are adjusted so that the hydrogen occlusion material is kept from covering a whole surface of the phosphor particle 52*b*. The remaining part of the illustrated embodiment may be constructed in substantially the same manner as the embodiment of FIG. 8 or 10.

In each of the embodiments described above, the hydrogen occlusion material such as Zr, V or the like inherently contains $H_2$. However, it is volatilized during manufacturing of the FED. Thus, $H_2$ at a suitable partial pressure may be encapsulated in the envelope when the envelope is airtightly sealed. $H_2$ encapsulated is occluded in the hydrogen occlusion material. Then, it is impinged by electrons during operation of the device, to thereby be discharged in the envelope. Such a phenomenon is repeated.

While preferred embodiments of the invention have been described with a certain degree of particularity with reference to the drawings, obvious modifications and variations are possible in light of the above teachings. It is therefore to be understood that within the scope of th appended claims, the invention may be practiced otherwise than as specifically described.

What is claimed is:

1. A cold cathode electronic device comprising:

a cathode electrode;

a gate electrode; and an anode electrode;

said cathode electrode field-emitting electrons;

said electrons field-emitted from said cathode electrode being permitted to reach at least any one of said gate electrode and anode electrode at the time when a gate voltage is applied between said gate electrode and said cathode electrode and an anode voltage is applied between said cathode electrode and said anode electrode;

at least a part of at least any one of said gate electrode and anode electrode including a hydrogen occlusion metal.

2. A cold cathode electronic device comprising:

a cathode electrode;

a gate electrode;

an anode electrode;

said cathode electrode field-emitting electrons;

said electrons field-emitted from said cathode electrode being permitted to reach at least any one of said gate electrode and anode electrode at the time when a gate voltage is applied between said gate electrode and said cathode electrode and an anode voltage is applied between said cathode electrode and said anode electrode;

at least a part of at least any one of said gate electrode and anode electrode including a hydrogen occlusion metal; and a control unit for varying a drive signal fed to any electrode selected from said cathode electrode, gate electrode and anode electrode;

said drive signal varied by said control unit permitting the amount of electrons emitted to be controlled by controlling a current of any electrode selected from said gate electrode and anode electrode, so that said electrons controlled are impinged on said hydrogen occlusion metal to discharge hydrogen gas therefrom.

3. A cold cathode electronic device as defined in claim 1 or 2, wherein said drive signal fed to any electrode selected from said cathode electrode, gate electrode and anode electrode is a pulse signal;

a variation of said pulse signal being a variation in any one selected from the group consisting of a pulse width of said pulse signal, a pulse height thereof and the number of pulses thereof.

4. A cold cathode electronic device as defined in claim 3, wherein said pulse signal is varied in correspondence to a variation in an anode current of said anode electrode detected.

5. A cold cathode electronic device as defined in claim 4, wherein when said anode current is reduced, a current of said electrode of which at least a part includes said hydrogen occlusion metal is increased to increase discharge of hydrogen gas from said hydrogen occlusion metal, to thereby enhance electron emission of said cathode electrode; and when said anode current is increased, a current of said electrode of which at least a part includes said hydrogen occlusion metal is reduced to reduce discharge of hydrogen gas from said hydrogen occlusion metal, to thereby stabilize electron emission of said cathode electrode.

6. A cold cathode electronic device as defined in claim 1 or 2, wherein said hydrogen occlusion metal is selected from the group consisting of Nb, Zr, V, Fe, Ta, Ni and Ti.

7. A cold cathode electronic device as defined in claim 1 or 2, wherein said hydrogen occlusion metal occludes $CH_4$ gas as well as said hydrogen gas and discharges $CH_4$ gas as well as said hydrogen gas due to impingement of said electrons thereon.

8. A field emission luminous device comprising:

a cathode electrode including emitter electrodes for field-emitting electrons;

a gate electrode; and an anode electrode including a phosphor layer for emitting light due to impingement of said electrons thereon;

said electrons field-emitted from said cathode electrode being permitted to impinge on said anode electrode, leading to luminescence of said phosphor layer;

at least a part of said gate electrode including a hydrogen occlusion metal;

said gate electrode having an electron drawing voltage applied thereto while a voltage is kept from being applied to said anode electrode in response to switching of said anode electrode during non-luminescence of said phosphor layer;

said hydrogen occlusion metal having said field-emitted electrons impinged thereon, resulting in hydrogen gas being discharged from said hydrogen occlusion metal.

9. A field emission luminous device comprising:

a cathode electrode including emitter electrodes for field-emitting electrons;

a gate electrode; and an anode electrode including a phosphor layer for emitting light due to impingement of said electrons thereon;

said electrons field-emitted from said cathode electrode being permitted to impinge on said anode electrode, leading to luminescence of said phosphor layer;

said anode electrode including a display anode electrode including said phosphor layer and a hydrogen discharge anode electrode which is electrically separated from said display anode electrode and free of said phosphor layer and of which at least a part includes hydrogen occlusion metal;

said hydrogen discharge anode electrode being fed with a drive signal independent from that of said display anode electrode;

said hydrogen occlusion metal of said hydrogen discharge anode electrode having said field-emitted electrons impinged thereon, to thereby discharge hydrogen gas therefrom.

10. A field emission luminous device comprising:

a cathode electrode including emitter electrodes for field-emitting electrons;

a gate electrode; and an anode electrode including a phosphor layer for emitting light due to impingement of said electrons thereon;

said electrons field-emitted from said cathode electrode being permitted to impinge on said anode electrode, leading to luminescence of said phosphor layer;

at least a part of said gate electrode including hydrogen occlusion metal; and a focusing electrode arranged between said gate electrode and said anode electrode and having a voltage applied thereto;

said voltage applied to said focusing electrode being controlled to vary a rate of distribution of a current fed to said gate electrode and anode electrode, so that a required amount of electrons may be impinged on said hydrogen occlusion metal of said gate electrode to discharge a required amount of hydrogen gas from said hydrogen occlusion metal.

11. A cold cathode luminous device comprising:

a cathode conductor;

a cold cathode arranged on said cathode conductor so as to emit electrons;

an anode conductor; and a phosphor layer arranged on said anode conductor;

said electrons emitted from said cold cathode being impinged on said phosphor layer, leading to luminescence of said phosphor layer;

said phosphor layer having a hydrogen occlusion metal powder added thereto.

12. A cold cathode luminous device as defined in claim 11, wherein said hydrogen occlusion metal powder is adhered to a surface of said phosphor layer or a surface of a phosphor particle constituting said phosphor layer.

13. A cold cathode luminous device as defined in claim 11, wherein said phosphor layer is formed of a paste made by mixing a phosphor particle and said hydrogen occlusion metal powder with each other.

14. A cold cathode luminous device as defined in claim 11, wherein said phosphor layer is constituted of a phosphor powder of 1 to 10 $\mu$m in particle size and said hydrogen occlusion metal powder has a particle size of 0.01 to several $\mu$m.

15. A cold cathode luminous device comprising:

a cold cathode conductor for field-emitting electrons;

an anode conductor;

a phosphor layer arranged on said anode conductor so as to emit light due to impingement of said electrons thereon; and an airtight envelope in which said cold cathode, anode conductor and phosphor layer being received;

said envelope having hydrogen gas encapsulated therein;

said phosphor layer having a hydrogen occlusion metal powder added thereto.

* * * * *